United States Patent [19]

Schlesinger

[11] 3,988,159

[45] Oct. 26, 1976

[54] LIGHT-SENSITIVE MATERIAL CONTAINING NITRONE FOR FORMING HEAT-FIXED IMAGES

[75] Inventor: Sheldon Irwin Schlesinger, Hightstown, N.J.

[73] Assignee: American Can Company, Greenwich, Conn.

[22] Filed: July 2, 1973

[21] Appl. No.: 375,348

Related U.S. Application Data

[60] Division of Ser. No. 93,414, Nov. 27, 1970, which is a continuation of Ser. No. 656,685, July 28, 1967, abandoned.

[52] U.S. Cl. ..... 96/88; 96/90 R; 96/115 P; 204/159.23; 204/159.24

[51] Int. Cl.[2] ..... G03C 1/00; G03C 1/52; G03C 1/68

[58] Field of Search ..... 96/88, 115 P, 90 R; 204/159.23, 159.24

[56] References Cited

UNITED STATES PATENTS

| | | | |
|---|---|---|---|
| 2,426,894 | 9/1947 | McQueen | 96/90 R |
| 3,042,517 | 7/1962 | Wainer | 96/90 R |
| 3,416,922 | 12/1968 | Sus et al. | 96/88 |
| 3,481,739 | 12/1969 | Wainer et al. | 96/90 R |
| 3,502,476 | 3/1970 | Itano et al. | 96/90 R |
| 3,582,342 | 6/1971 | Itano et al. | 96/90 R |
| 3,615,568 | 10/1971 | Jenkins | 96/90 R |
| 3,699,026 | 10/1972 | Jenkins et al. | 96/115 P |

OTHER PUBLICATIONS

Hamer, et al: Chemical Review, 1964, (nitrones).

*Primary Examiner*—Won H. Louie, Jr.
*Attorney, Agent, or Firm*—Robert P. Auber; Ernestine C. Bartlett; Ira S. Dorman

[57] ABSTRACT

The use of photosensitive nitrones in an imageformation system, if desired with auxiliary compounds for intensifying the photolytically formed image or for improving the fixing of the image, wherein the image is fixed by the use of heat.

29 Claims, No Drawings

LIGHT-SENSITIVE MATERIAL CONTAINING NITRONE FOR FORMING HEAT-FIXED IMAGES

CROSS-REFERENCE TO RELATED APPLICATION

This is a division of application Ser. No. 93,414, filed Nov. 27, 1970, which in turn is a continuation of my earlier filed application Ser. No. 656,685 filed July 28, 1967, now abandoned.

BACKGROUND OF THE INVENTION

This invention relates to new image-formation systems wherein the photosensitive material is a nitrone and in which the image may be fixed by the use of heat. It is known to use nitrone in the formation of photographic images. In U.S. Pat. No. 2,426,894 nitrones are used in the production of images, but the method for fixing the image requires the use of aqueous washing procedures. The present system enables one to eliminate the necessity for aqueous washing and substitutes therefor heat treatment to fix the image.

In the process of the present invention, it is possible to use any photosensitive nitrone. A nitrone is an organic compound of the formula

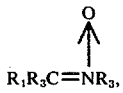

wherein $R_1$ and $R_2$ can be any alkyl or aryl group, $R_2$ can be hydrogen, an alkyl or aryl group. $R_1$, $R_2$, and $R_3$ may be substituted. The nitrones wherein $R_1$ and $R_3$ are aryl groups are particularly valuable because these compounds have ultraviolet absorption maxima in the photographically useful region of the spectrum, above 300 m$\mu$. These may be represented by the formula $RCH{=}N(\rightarrow O)R'$, where R and R′ are aryl groups, while certain other groups have been found likewise to be particularly beneficial as the R group in such nitrones.

It is highly to be desired to find a new, efficient system for the direct reproduction of images. The nitrone system produces a negative image of a positive. It is a reverse process, not a direct process, useful for example for the duplication of office correspondence, for the formation of microfilm records and so on. There are many commercial duplicating systems which are now in satisfactory operation, but most exhibit some undesirable characteristics. The diazo system requires either the use of aqueous developers, gaseous ammonia or a dry reagent that yields an alkaline material upon heating, which makes for a complicated process. The systems based on the use of sensitive silver salts are proportionately expensive. If the reproduction system is to be used to form microfilm copies, it is necessary for the system to be capable of excellent definition. The systems of the present invention are capable of finer definition than conventional silver halide/gelatin systems.

SUMMARY OF THE INVENTION

The novel process provided by the present invention comprises exposing, to an actinic-light image, a photosensitive element or medium comprising a support having in operative association therewith a nitrone of the formula

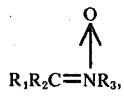

and fixing the exposed element by heat treatment. Preferred are photosensitive nitrones having the formula $RCH{=}N(\rightarrow O)R'$ where R is selected from the group consisting of aryl including substituted phenyl, aroyl, arylvinylene, and furyl groups and R′ is an aryl group including substituted phenyl, said substituted phenyl having one or two substitutents selected from the group consisting of dimethylamino, hydroxy, methoxy, methyl and nitro. The exposure to actinic radiation should be carried out for a sufficent period of time to cause a chemical change in the nitrone in the exposed areas, converting the exposed nitrone to a durable product giving increased optical densities in the exposed image areas. The light-sensitive medium for forming the visible images advantageously carries, in addition to the nitrone compound, one or more auxiliary compounds for improving optical density in exposed image areas or for facilitating heat-fixing or unexposed or partially exposed image areas. More specifically, the light-sensitive medium for forming the visible images comprises a support carrying a photosensitive nitrone of the type defined above and also at least one auxiliary compound for increasing the permanent contrast between exposed and unexposed image areas, said auxiliary compound being selected from the group consisting of an image-intensifier such as diphenylamine, a heat-fixing catalyst such as tricresyl phosphate, and an unsaturated heat fixing reagent such as acrylonitrile. It will appear that the terms "photosensitive" and "light-sensitive" as used herein refer to sensitivity to actinic radiation generally, the radiation preferably being ultraviolet light or visible light or both.

DETAILED DESCRIPTION

The nitrones used in accordance with the present invention are generally of the formula

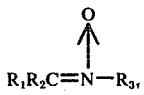

wherein $R_1$ or $R_3$ may be alkyl or aryl or it may be a substituted alkyl or aryl, while $R_2$ may be a hydrogen, alkyl, aryl, substituted alkyl or aryl. The nitrones that are useful in this invention undergo a visible color change when exposed to actinic radiation or may produce a visible change by reaction of their photochemical-reaction products or intermediates with other added reagents. Preferred are the nitrones with an aryl, aroyl, arylvinylene, or furyl group on the alpha carbon and an aryl group on the nitrogen. Examples of these nitrones are:

- alpha,N-diphenylnitrone
- alpha-(3,4-dimethoxyphenyl)-N-phenylnitrone
- alpha-(p-nitrophenyl)-N-phenylnitrone
- alpha-(p-methoxyphenyl)-N-phenylnitrone
- N-(p-dimethylaminophenyl)diphenylenemethylenenitrone (N-9-fluorenylidene-N′, N′-dimethyl-p-phenylenediamine N-oxide)
- alpha-(1-naphthyl)-N-phenylnitrone
- alpha-(2-hydroxyphenyl)-N-phenylnitrone alpha-phenyl-N-(1-naphthyl)nitrone
alpha-phenyl-N-(3-nitro-4-methylphenyl)nitrone
alpha,alpha′-p-phenylenebis-N-phenylnitrone
alpha,alpha′-bis(diphenylnitrone)
alpha-(3,4-dihydroxyphenyl)-N-phenylnitrone
alpha-(p-hydroxyphenyl)-N-phenylnitrone
alpha-(4-hydroxy-3-methoxyphenyl)-N-phenylnitrone
alpha-phenyl-N-(m-nitrophenyl)nitrone
alpha-(2,4-dinitrophenyl)-N-(dimethylaminophenyl)nitrone
alpha-(p-dimethylaminophenyl)-N-phenylnitrone
alpha-benzoyl-N-phenylnitrone
alpha-benzoyl-N-(p-dimethylaminophenyl)nitrone
alpha-[2-(1-naphthyl)vinylene]-N-phenylnitrone
alpha-(trans-styryl)-N-phenylnitrone
alpha-(2-furfuryl)-N-phenylnitrone The present process uses a heat treatment to remove the unexposed photosensitive nitrones from the system. The heat-fixing may be accomplished with or without the addition of fixing agents, although the addition of fixing agents may increase the speed and efficiency of the fixing.

If the heat treatment is carried on adequately in the absence of an added fixing agent, the heating of the substrate bearing the nitrone results in the rearrangement or decomposition of the nitrone to a practically colorless and non-photosensitive product. As illustrated in the examples hereinbelow, the heat-treating operation is carried out to maintain the nitrone at a temperature of at least 100° C, and preferably approximating 135° C, for an effective period which may be quite short, or which may be achieved by heating the medium for a quarter hour to two hours, thus converting the nitrone in unexposed image areas to a radiation-stable product of low optical density without substantially decreasing the increased optical densities which have been obtained in the exposed image areas. For example, the rearrangement of alpha,N-diphenylnitrone to the benzanilide upon heat-fixing results in a colorless non-sensitive product according to the following equation:

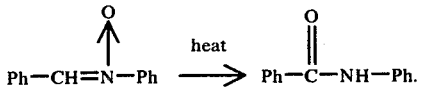

The rearrangement advantageously may be catalyzed by the addition of such catalysts as phosphorus trichloride, phosphorus pentachloride, sulfur dioxide, thionyl chloride, acetic anhydride, maleic anhydride, and tricresyl phosphate. The catalyst may be added to the system by incorporation of a precursor in the photosensitive layer which would yield the agent upon application of heat.

The fixation of the image may be also improved by the addition of a reagent which reduces or deoxygenates the unexposed portions of the nitrone to an inactive form. Such reagents may be phosphines, sulfur dioxide, sulfur or precursors of these.

The efficiency of the thermal fixing may be greatly improved by incorporating into the photosensitive composition an ethylenically unsaturated compound such as acrylamide, N-methylolacrylamide, N,N′-methylene bisacrylamide, acrylonitrile, styrene, N-methylomethacrylamide, substituted acrylamides (note the methyl-substituted compound methacrylamide, carrying also an additional N-substituent, just mentioned), N-vinylsuccinimide, N-vinylphthalimide, dimethyl fumarate and esters of acrylic and methacrylic acids, fumaronitrile, 3-sulfolene, and N-phenylacrylamide, as well as derivatives of acetylene such as phenylacetylene.

The efficiency of the thermal fixing in the presence of an unsaturated compound may be further enhanced by the presence of certain salts, such as lithium bromide, lithium p-toluenesulfonate or piperidinium p-toluenesulfonate.

The intensity of the nitrone image may be improved by the addition of organic amines and substituted phenols, e.g. alkoxyphenols, as intensifiers, for example, diphenylamine and p-phenylenediamine and their derivatives such as the N-aryl-substituted N,N′-diphenyl-p-phenylenediamine, indole, carbazole, benzimidazole, rhodanine, indole derivatives such as 3-indolylacetic acid, or p-methoxyphenol.

The rearrangement catalysts for facilitating heat-fixing, the unsaturated heat-fixing reagents, and the diphenylamine and other image intensifiers will be seen to constitute together a group of auxiliary compounds which, cooperating with the photosensitivity and heat-fixing properties of the nitrones alone, expedite or increase the permanent contrast obtainable between exposed and unexposed image areas in the visible image which is formed in the light-sensitive coated substrate or medium of the invention.

The nitrones of the present invention may be prepared by the condensation of N-monoarylhydroxylamines with aldehydes and ketones as in U.S. Pat. No. 2,426,894, or by the methods outlined by Hamer and Macaluso in Chemical Reviews, Vol. 64, Aug., 1964, pages 474–492.

The nitrones may be utilized by impregnating them into at least a surface layer of a sheet of paper, cloth or other material. A supporting sheet carrying nitrone may be made by incorporating the nitrone into a film or layer coated on a plastic or metal substrate. Alternatively, a support may be made to carry the nitrone by incorporating the nitrone into a plastic film itself. The films may include cellulose acetate butyrate, cellulose acetate, lexan, microwaxes, polystyrene, polycarbonate, low-molecular weight polyethylene, etc.

The following examples demonstrate the utility of the nitrones in a system where the image is heat-fixed. The densities of the images produced by the nitrones were read with a Welch Densichron Model 1 densitometer, using the reflection head for reading opaque images such as on paper and the transmission head for the transparent film images. The Welch Densichron conversion table was used to convert to percent reflection or transmission. The incident light colors referred to with respect to optical densities and percent reflections or transmissions were obtained using the following Kodak Wratten filters:

| TRANSMISSION HEAD FILTERS | |
|---|---|
| Filter No. | Transmission Peak, μ |
| 92 Red | 700 |
| 99 Green | 550 |
| 98 Blue | 430 |
| REFLECTION HEAD FILTERS | |
| Filter No. | Transmission Peak, μ |

-continued

| | |
|---|---|
| 25A Red | 700 |
| 58B Green | 530 |
| 47B Blue | 430 |

The degree of fixing of the photosensitive layer is derived from the percent difference between the reflection or transmission of the area of the test film exposed to actinic light before heating and the area exposed after heating.

The values quoted in the following tables are not the absolute differences between the percent reflections or the percent transmissions of each image but are the percent differences based upon the higher of the two values being compared.

In the reflection reading, the instrument was standardized with the white paper to be irradiated (which would later bear the image), and the standard value was subtracted from the actual reading to get the true optical density due to the photochemical reaction. With transmission readings, the same procedure was followed, using a clear unirradiated sample of the film as the standard. The relation between the optical density and the percent transmission or reflection is given by the equation $D = \text{Log}\ (Po/Pt)$.

D = optical density

Po = incident light

Pt = transmitted or reflected light

The percent reflection or transmission is given instead of the optical density because it is more meaningful for comparison of image intensities. For example, an optical density of 1 corresponds to a percent reflection of 10%, while an optical density of 2 corresponds to 1% reflection. Unless one is always aware that logarithmic values are dealt with in optical densities, it is not always readily apparent that the latter value indicates 10 times the blackness of the former value. The use of percent reflection values makes this relationship more readily apparent. It should be remembered that the lowest percent reflection-transmission values represent the blackest or densest images. The Welch conversion table was used to derive percent reflection and transmissions from the observed optical density.

EXAMPLE I

A series of solutions is prepared. All solutions contain 0.200N alpha, N-diphenylnitrone. To a 5 ml. aliquot of this solution, 0.154 gram of N,N'-methylenebisacrylamide is added. To a 10 ml. aliquot of the solution, 0.196 gram of maleic anhydride is added. To a 10 ml. aliquot of the solution, 1 drop of acetic anhydride is added. Two spots, individually designated spot A and spot B, are formed from each solution, including the two spots from the initial solution without a fixing agent, on samples of Whatman No. 2 filter paper. The spots are colorless upon drying. Spot A, of each, is exposed for 5 minutes at 12 cm distance from a 300-watt Gates Raymaster ultraviolet source. All the samples of filter paper are then heated at 135° C. for 1 hour. Following the heating, spot B is exposed for 5 minutes in the same manner as spot A. The following table shows the percent reflection data for each of the two spots and the percent difference due to fixing.

% REFLECTIONS OF EXPOSED SAMPLE SPOTS A—PAPER

| | | % Reflections of Different Colored Lights | | | |
|---|---|---|---|---|---|
| Added Fixing Agent | Spot Exposed | White | Red | Green | Blue |
| None | A—Before heating | 47.86 | 69.18 | 51.29 | 29.51 |
| | B—After heating | 66.07 | 83.18 | 67.61 | 51.29 |
| | % Differences | 18.21 | 14.00 | 16.30 | 21.80 |
| N,N'-methylenebis-acrylamide | A—Before heating | 47.86 | 74.13 | 46.77 | 26.92 |
| | B—After heating | 83.18 | 95.50 | 89.13 | 66.07 |
| | % Differences | 42.46 | 22.38 | 47.53 | 60.77 |
| Maleic anhydride | A—Before heating | 35.50 | 57.50 | 35.50 | 20.90 |
| | B—After heating | 66.07 | 85.10 | 66.07 | 46.80 |
| | % Differences | 47.80 | 32.40 | 46.30 | 55.40 |
| Acetic anhydride | A—Before heating | 44.70 | 69.20 | 44.70 | 25.10 |
| | B—After heating | 63.10 | 81.30 | 63.10 | 46.80 |
| | % Differences | 29.20 | 14.90 | 29.20 | 46.30 |

As is evidenced in the above table, the spots (spot A) which are exposed and then fixed by heat produce a denser image than the spots which are heated before exposure. The percent reflections are consistently higher in the latter case of spot B.

EXAMPLES II – XI

The following series of experiments show the result of heat-fixing alpha,N-diphenylnitrone in cellulose acetate film. A film is formed on Mylar from a solution of 0.396 gram alpha, N-diphenylnitrone in 12.1 grams of 17.5% cellulose acetate in acetone. The dried film is divided into four areas, areas 1, 2, 3, and 4. Areas 3 and 4 are exposed for 15 minutes at 12 cm distance from a 300-watt Gates Raymaster ultraviolet source. The film sample is then heated at 135° C for 1 hour. Areas 2 and 4 of the film samples are then exposed to the same ultraviolet treatment as before. The optical densities to transmitted light are then read and converted to percent transmission. Area 1, which is not exposed, remains clear.

Solutions in the following series are prepared containing different additives and then are cast on a Mylar strip and treated in the same way as the film containing only the nitrone. In each case, area 1, the area which was not exposed to ultraviolet light, remains clear. A variety of ethylenically unsaturated compounds is used in Examples III–IX. As Example III, a solution of N-methylolmethacrylamide in the amount of 1.5 molar equivalents based on the nitrone is added to a base solution of the diphenylnitrone in cellulose acetate dissolved in acetone equivalent to 22% of the dry cellulose acetate weight. As Example IV, N-methylolacrylamide equivalent to 1.5 molar equivalents is added to the above base diphenylnitrone solution. One molar equivalent of N-vinylphthalimide is added to the base diphenylnitrone solution to give Example V. Dimethylfumarate is added to another quantity of base solution in the amount of 1 equivalent to produce Example VI. Fumaronitrile, as Example VII, is added to the base solution in the amount of 1 equivalent. As Example VIII, 3sulfolene is added to the base solution in the amount of 1.1 equivalents. Styrene in Example IX is added in the amount of 1.5 equivalents. The acetylenically unsaturated compound phenylacetylene, as Example X, is added in the amount of 1.5 equivalents. Finally, as Example XI, one drop of tricresyl phosphate is added as a heat-fixing catalyst to the stated base solution. The results from these different compositions are shown in the following table:

N-methylolmethacrylamide is determined. Three solutions are formed, each having 0.374 gram of diphenylnitrone, 0.292 gram of N-methylolmethacrylamide, and 10 grams of 17% cellulose acetate in acetone. To produce Example XII, 0.020 gram of lithium bromide is added to one solution. As Example XIII, 0.020 gram of lithium p-toluenesulfonate is added to yet another of the solutions. Finally, as Example XIV, 0.05 gram of piperidinium p-toluenesulfonate is added to the remaining prepared solution. Films are passed from these solutions on Mylar D producing a 7-mils wet thickness. The films are divided into sections as in Example II, etc., and treated as in connection therewith. However, it is found that only 15 minutes of heating at 135° C is necessary to give the same fixing results as obtained at

HEAT-FIXING TEST DATA IN CELLULOSE ACETATE FILM

| | | | % Transmission | | | |
|---|---|---|---|---|---|---|
| Example | Added Agent | Area | White | Red | Green | Blue |
| II | None | 2 | 79.40 | 95.50 | 83.20 | 47.90 |
| | | 4 | 68.00 | 89.10 | 71.00 | 32.00 |
| | | % Difference | 13.90 | 6.30 | 14.40 | 33.40 |
| III | N-methylol-methacrylamide | 2 | 87.10 | 87.10 | 83.18 | 61.66 |
| | | 4 | 60.26 | 81.28 | 64.57 | 13.18 |
| | | % Difference | 30.80 | 6.68 | 22.40 | 78.80 |
| IV | N-methylol-acrylamide | 2 | 93.33 | 91.20 | 89.13 | 70.79 |
| | | 4 | 53.70 | 77.62 | 58.88 | 10.47 |
| | | % Difference | 42.40 | 14.90 | 34.00 | 85.00 |
| V | N-vinylphthal-imide | 2 | 87.10 | 91.20 | 91.20 | 66.07 |
| | | 4 | 63.10 | 83.18 | 69.18 | 22.91 |
| | | % Difference | 27.60 | 8.80 | 24.20 | 65.20 |
| VI | Dimethylfumarate | 2 | 91.20 | 95.50 | 93.33 | 74.13 |
| | | 4 | 64.57 | 79.43 | 70.79 | 27.54 |
| | | % Difference | 29.20 | 18.80 | 24.20 | 63.00 |
| VII | Fumaronitrile | 2 | 81.28 | 91.20 | 83.18 | 54.95 |
| | | 4 | 54.95 | 79.43 | 61.66 | 15.14 |
| | | % Difference | 32.40 | 12.90 | 25.90 | 72.70 |
| VIII | 3-Sulfolene | 2 | 66.07 | 89.13 | 72.44 | 28.84 |
| | | 4 | 52.48 | 75.86 | 57.54 | 14.45 |
| | | % Difference | 20.60 | 14.90 | 20.60 | 49.80 |
| IX | Styrene | 2 | 75.86 | 87.10 | 85.11 | 69.18 |
| | | 4 | 52.48 | 77.62 | 63.10 | 21.38 |
| | | % Difference | 34.00 | 10.90 | 24.70 | 69.00 |
| X | Phenylacetylene | 2 | 69.18 | 89.13 | 75.86 | 37.15 |
| | | 4 | 57.54 | 79.43 | 61.66 | 15.85 |
| | | % Difference | 16.90 | 10.90 | 18.70 | 57.40 |
| XI | Tricresyl phosphate | 2 | 91.20 | 97.72 | 93.33 | 63.10 |
| | | 4 | 60.26 | 83.18 | 63.10 | 20.42 |
| | | % Difference | 33.90 | 14.90 | 32.50 | 67.70 |

As shown in the above table, the results as evidenced from area 4 consistently show the lowest percent transmission and therefore area 4 contains the darkest image.

the 1-hour reading without lithium bromide or lithium p-toluenesulfonate. The film containing piperidinium p-toluenesulfonate is heated for 30 minutes. The following table shows the extent of fixing difference of the different films:

% TRANSMISSION DATA FOR FILMS SHOWING EFFECT OF ADDED SALTS

| | | | % Transmission | | | |
|---|---|---|---|---|---|---|
| Example | Salt Added | Film Area | White | Red | Green | Blue |
| XII | Lithium bromide | 2 | 91.20 | 95.50 | 95.50 | 79.43 |
| | | 4 | 64.57 | 87.10 | 72.44 | 19.50 |
| | | % Difference | 29.20 | 8.80 | 24.15 | 75.45 |
| XIII | Lithium p-toluene-sulfo-nate | 2 | 95.50 | 95.50 | 95.50 | 87.10 |
| | | 4 | 70.79 | 89.13 | 77.62 | 27.54 |
| | | % Difference | 25.90 | 6.70 | 18.70 | 68.30 |
| XIV | Piperidinium p-toluenesulfo-nate | 2 | 97.77 | 100.0 | 89.10 | 83.20 |
| | | 4 | 61.70 | 91.2 | 70.80 | 14.50 |
| | | % Difference | 36.90 | 8.8 | 20.50 | 82.60 |

EXAMPLES XII – XIV

The effect of the addition of various salts on the image produced from a solution of nitrone containing As shown in the above table, the addition of the catalysts speeds the fixation of the nitrone image. The same results, substantially, are obtained as were obtained in the previous examples in ¼ to ½ the heating time.

EXAMPLE XV

The effect of different intensifiers is determined in this and following examples. A solution of 0.572 gram of diphenylnitrone, 0.383 gram of N,N'-diphenyl-p-phenylenediamine, and 0.500 gram of N-methylolmethacrylamide is prepared in 15 grams of 17.3% cellulose acetate in acetone. The film is cast on Mylar producing a wet film of 7-mils thickness. The film is divided into four areas and exposed as in the immediately foregoing above examples. Areas 3 and 4 are combined as area 4 and exposed for 15 minutes at 20 cm distance from the 300-watt Gates Raymaster ultraviolet source. The exposed area 4 turns orange in color. The film is then heated at 135° C. for 2 hours, causing the orange exposed areas to turn purple. Areas 2 and 4 are then exposed for 15 minutes. Area 1 remains unexposed. Optical density data are taken. The following table shows the results of the experiment:

| | % Transmission | | | |
|---|---|---|---|---|
| Area | White | Red | Green | Blue |
| 1. Unexposed | 79.4 | 83.2 | 79.4 | 55.0 |
| 2. Exposed after heating | 63.1 | 75.9 | 60.3 | 35.5 |
| 4. Exposed before heating | 3.8 | 21.9 | 1.6 | 2.3 |
| % Difference between 2 and 4 | 94.0 | 71.2 | 97.4 | 93.7 |
| % Change in maximum density due to intensifier (Compared with Example III) | 92.0 | 73.0 | 97.6 | 82.6 |

The addition of N,N'-diphenyl-p-phenylenediamine produces a startling reduction in the amount of light transmitted. The color produced is intensified greatly, as shown by data on area 4.

The same film can also be exposed through a Kodak 21 step tablet transparency to produce 11 steps of orange which become 11 steps of purple upon heating.

EXAMPLE XVI

The N,N'-diphenyl-p-phenylenediamine is replaced by p-methoxyphenol as an intensifier. A solution is prepared containing 0.434 gram of p-methoxyphenol in 10 ml. of 0.35N solution of alpha,N-diphenylnitrone in acetone. This solution is spotted on three pieces of Whatman No. 2 filter paper. The first paper is exposed to a Gates Raymaster ultraviolet source for 15 minutes at 15 cm distance and then heated for 2 hours at 135° C. The second paper is exposed but not heated. The third paper is heated but not exposed. A fourth paper is treated with 0.35 normal diphenylnitrone solution without added intensifier. This paper is exposed. The following table shows the results of the example.

| | % Reflection | | | |
|---|---|---|---|---|
| Paper Sample | White | Red | Green | Blue |
| Exposed and heated | 28.2 | 38.2 | 24.0 | 17.8 |
| Exposed only | 24.6 | 38.9 | 20.4 | 16.6 |
| Heated only | 100.0 | 95.5 | 100.0 | 97.7 |
| Nitrone with no intensifier (exposed) | 41.7 | 66.1 | 40.7 | 21.9 |

The addition of p-methoxyphenol does not produce as great intensification as the addition of N,N'-diphenyl-p-phenylenediamine. However, the color is substantially darker than in the experiments without the intensifier as shown by the low percent reflections.

EXAMPLE XVII

A solution of 0.95 gram of alpha,N-diphenylnitrone and 1.206 grams of N-methylolmethacrylamide is prepared in 100 ml. of methanol. The solution is spotted on Whatman No. 2 filter paper and dried. The paper is then exposed to an NBS line pattern by a Gates Raymaster ultraviolet lamp at a distance of 11 cm. The areas of the paper receiving light became brown while the unexposed areas remained white. The pattern is reproduced in sharp resolution. The paper is then heated at 110° C. for 15 hours. Re-exposure of one-half of the paper to ultraviolet light under the same conditions as the first exposure results in no more than a slight yellowing of the background areas which is originally white. The contrast remains excellent. The experiment is repeated and the paper is heated to a temperature of 135° C. instead of 110° C. At this temperature, only 1 hour of heat treatment is required.

EXAMPLE XVIII

A solution of 0.30 gram of alpha,N-diphenylnitrone of 0.233 gram of N-methylolmethacrylamide and 9.10 grams of 22.4% polystyrene in ethyl acetate is prepared. This solution is drawn on Mylar film to produce a film having a thickness of 7 mils wet. The film is exposed to an image of ultraviolet light for 6 minutes at 17.5 cm distance. An excellent reproduction of the photographic negative is produced. A yellow-brown color is produced where light passed through the negative and the film is clear in other areas. The films are heated at 100° C. for 24 hours. Re-exposure to the ultraviolet light does not cause noticeable darkening of the background or fading of the image when viewed under white light. The experiment is repeated and the film is heated for only 4 hours after exposure. Fixation is complete in this shorter time.

EXAMPLE XIX

A solution of 0.879 gram of alpha,N-diphenylnitrone and 0.778 gram of N-methylolmethacrylamide is prepared in 16.30 grams of 24.3% cellulose acetate in acetone. A film was cast from this solution. A portion of the surface of the film is exposed to ultraviolet light for 2 minutes at 11.5 cm distance while the remainder of the surface is covered. After heating the film sample at 135° C. for 2 hours, a second portion of the film is exposed to ultraviolet light for 3 minutes with an area still unexposed. The optical densities of these three areas are shown in the following table:

| Area | White Light O.D. | Blue Light O.D. |
|---|---|---|
| Unexposed area | 0.03 | 0.10 |
| Exposed before heating | 0.14 | 0.60 |
| Exposed after heating | 0.06 | 0.18 |

It will be noted that the area which is exposed before heating produced a dense image.

EXAMPLE XX

The solution of 0.394 gram of alpha,N-diphenylnitrone and 0.154 gram of N,N'-methylenebisacrylamide is prepared in 10 ml. of ethanol. The solution is spotted on three separate sheets of No. 2 Whatman filter paper identified as samples A, B and C. Samples B and C are placed immediately in a 100° C. oven. Sample A is kept at room temperature. After one hour, sample B is cooled to room temperature and exposed to ultraviolet light for 5 minutes at 20 cm distance. Sample A is also exposed to ultraviolet light for 5 minutes at 20 cm distance. Sample C is exposed to ultraviolet light for 5 minutes at 20 cm distance after being heated for 24 hours at 100° C. The optical densities of these spots are shown in the following table:

| Sample | White Light O.D. | Blue Light O.D. |
|---|---|---|
| A | 0.44 | 0.70 |
| B | 0.23 | 0.39 |
| C | 0.14 | 0.27 |

It will be appreciated that the prolonged heating for 24 hours results in a much less dense image.

EXAMPLE XXI

The effect of the addition of diphenylamine to diphenylnitrone on the maximum optical density of the photochemical-reaction product of the mixture is determined in this example.

The molar proportions of nitrone to amine ranged from 20 to 1 to 0.63 to 1 in gradual increments. A series of solutions is formed by adding diphenylamine to a 0.350 molar solution of alpha-N-diphenylnitrone in ethanol. Each solution was spotted on filter paper and exposed to ultraviolet radiation for 5 minutes at 20 cm distance after drying. An air blower is used to keep the surface temperature of the spots from exceeding 35° C. A plot of the percent reflections of these spots to white, red, green, and blue light versus the concentration of amine results in a smooth curve showing that the percent reflection decreases with added amine. A decrease in percent reflection corresponds to an increase in optical density. The following table gives the data for the 20 to 1 solution and the 0.63 to 1 solution as well as for the solution of nitrone alone.

| Mole Ratio | % Reflection* | | | |
|---|---|---|---|---|
| Nitrone:Amine | White light | Red light | Green light | Blue light |
| 20:1 | 31.62(24.15) | 50.12(24.14) | 30.20(25.87) | 18.20(16.82) |
| 0.63:1 | 16.60(60.18) | 21.88(66.88) | 15.85(61.34) | 12.02(45.06) |
| Nitrone alone in 0.350 M solution | 41.69 | 66.07 | 40.74 | 21.88 |

*Values in parentheses are the % differences due to added amine.

EXAMPLE XXII

The nitrones of the present invention may be used in the process of photocopying on paper. A solution of 8.65 grams of alpha,N-diphenylnitrone, 7.40 grams of diphenylamine and 8.10 grams of N,N'-methylenebisacrylamide is impregnated on a sheet of paper. The paper is exposed to a photographic negative by ultraviolet radiation from a Gates Raymaster lamp for one minute at 15 cm distance. An excellent contact print is formed which has excellent resolution and tone reproduction.

EXAMPLE XXIII

A sheet of paper impregnated as in Example XXII is exposed in contact with a photographic negative of a printed page. The print is reproduced in excellent resolution. It is fixed by heating at 135° C. for 1 hour. Color varied from chocolate brown through bluish brown to steel gray.

EXAMPLE XXIV

A solution of 0.20 gram of diphenylnitrone and 0.17 gram of diphenylamine in 17.2 grams of 29.1% solution of polystyrene in toluene is prepared. The solution is cast on Mylar producing 1-mil dry thickness. The film is exposed to a microfilm photographic negative by a Gates Raymaster ultraviolet lamp for 20 minutes at 17.5 cm distance. The resulting photographic negative has excellent resolution. The clear areas of the negative produced a brown color in the copy.

EXAMPLE XXV

N-phenylacrylamide is incorporated into the solution of Example XXIV. The resulting film has good heat-fixing properties.

EXAMPLE XXVI

A solution of 2.04 grams of diphenylnitrone, 0.87 gram of diphenylamine and 1.59 grams of N-methylolmethacrylamide in 50 grams of 18.5% cellulose acetate is prepared. A film is cast of Mylar from the solution to a thickness of 1-mil dry. The films are exposed to a photographic negative by ultraviolet light from a Gates Raymaster lamp for 7½ minutes at 20 cm distance. The films are heated at 135° C for 2 hours. Excellent contact print copies of the negative are produced.

EXAMPLES XXVII – XXIX

These examples show the effect of substituents such as a methoxy (or nitro) group on the alpha-phenyl group of alpha,N-diphenylnitrone. Solutions of a concentration of 0.175 M, each of alpha-(p-methoxyphenyl)-N-phenylnitrone, alpha-(3,4-dimethoxyphenyl)-N-phenylnitrone, and of alpha,N-diphenylnitrone, are coated on No. 2 filter paper.

The samples are irradiated for 30 minutes. The unexposed spots are yellow. The optical densities of the exposed spots are shown on the following table.

COMPARISON OF OPTICAL DENSITIES OF NITRONE IMAGES

| Example | White | Red | Green | Blue |
|---|---|---|---|---|
| alpha-(-p-methoxyphenyl)-N-phenylnitrone | 0.43 | 0.29 | 0.44 | 0.58 |
| alpha-(3,4-dimethoxyphenyl)-N-phenylnitrone | 0.33 | 0.19 | 0.36 | 0.47 |
| alpha,N-diphenylnitrone | 0.41 | 0.23 | 0.42 | 0.62 |

The methoxy substituent did not provide a denser image than the unsubstituted nitrone.

EXAMPLE XXX

The effect on the intensity of the image of the addition of diphenylamine to a coating containing diphenylnitrone is determined.

Diphenylnitrone is dissolved in ethanol to a concentration of 0.350M. Diphenylamine is added to give a concentration ranging from 0.0175M to 0.560M, in a series of solutions, and the solutions are spotted on filter paper, dried and irradiated. As the concentration of diphenylamine increases, the percent reflection decreases until equimolar proportions are reached, at which time the percent reflection changes less perceptibly (also see Example XXI).

It will be apparent that many changes and modifications of the several features described herein may be made without departing from the spirit and scope of the invention. It is therefore apparent that the foregoing description is by way of illustration of the invention rather than limitation of the invention.

What is claimed is:

1. A light-sensitive medium for forming visible heat-fixed images, consisting essentially of: a support carrying a composition consisting essentially of a photosensitive nitrone having the formula RCH=N(→O)R′, where R is selected from the group consisting of aryl, aroyl, arylvinylene, and furyl groups and R′ is an aryl group, said nitrone being adapted upon exposure to actinic radiation to be converted to a product giving increased optical densities in the exposed image areas, and image-intensifying means, for further increasing optical density responsive to said conversion of the nitrone upon exposure, in the form of a compound selected from the group consisting of diphenylamine, p-phenylenediamine, N,N′-diphenyl-p-phenylenediamine, indole, 3-indolylacetic acid, carbazole, benzimidazole, rhodanine, and p-methoxyphenol.

2. The light-sensitive medium of claim 1, in which each of the R and R′ groups of the nitrone is selected from the group consisting of phenyl, naphthyl, and substituted phenyl, said substituted phenyl having one or two substituents selected from the group consisting of dimethylamino, hydroxy, methoxy, methyl, and nitro.

3. The light-sensitive medium of claim 1, in which each of the R and R′ groups of the nitrone is selected from the groups consisting of phenyl and 1-naphthyl.

4. The light-sensitive medium of claim 1, in which said photosensitive nitrone is alpha,N-diphenylnitrone.

5. The light-sensitive medium of claim 3, in which the image-intensifying compound is diphenylamine.

6. The light-sensitive medium of claim 3, in which the image-intensifying compound is N,N′-diphenyl-p-phenylenediamine.

7. The light-sensitive medium of claim 3, in which the image-intensifying compound is p-methoxyphenol.

8. The light-sensitive medium of claim 1, in which said photosensitive nitrone is alpha,N-diphenylnitrone and said image-intensifying means is the compound N,N′-diphenyl-p-phenylenediamine.

9. A light-sensitive medium for forming visible heat-fixed images, consisting essentially of: a support carrying a composition consisting essentially of a photosensitive nitrone having the formula RCH=N(→O)R′, where R is selected from the group consisting of aryl, aroyl, arylvinylene, and furyl groups and R′ is an aryl group, and a heat-fixing catalyst in the form of a compound selected from the group consisting of tricresyl phosphate, phosphorus trichloride, phosphorus pentachloride, sulfur dioxide, thionyl chloride, acetic anhydride, and maleic anhydride whereby upon exposure to actinic radiation said nitrone is converted to a product giving increased optical densities in the exposure image areas of said medium, while upon subsequent heat-fixing said nitrone in unexposed image areas is converted to a radiation-stable product of low optical density.

10. The light-sensitive medium of claim 9, in which each of the R and R′ groups of the nitrone is selected from the group consisting of phenyl, naphthyl, and substituted phenyl, said substituted phanyl having one or two substituents selected from the group consisting of dimethylamino, hydroxy, methoxy, methyl, and nitro.

11. The light-sensitive medium of claim 9, in which each of the R and R′ groups of the nitrone is selected from the group consisting of phenyl and 1-naphthyl.

12. The light-sensitive medium of claim 9, in which said photosensitive nitrone is alpha, N-diphenylnitrone.

13. The light-sensitive medium of claim 9, in which the heat-fixing catalyst is tricresyl phosphate.

14. The light-sensitive medium of claim 11, in which the heat-fixing catalyst is tricresyl phosphate.

15. The light-sensitive medium of claim 9, in which said photosensitive nitrone is alpha,N-diphenylnitrone and said heat-fixing catalyst is tricresyl phosphate.

16. A light-sensitive medium for forming visible heat-fixed images consisting essentially of: a support carrying a composition consisting essentially of a photosensitive nitrone having the formula RCH=N(→O)R′, where R is selected from the group consisting of aryl, aroyl, arylvinylene, and furyl groups and R′ is an aryl group and an unsaturated compound for increasing the permanent contrast between exposed and unexposed image areas, said unsaturated compound being selected from the group consisting of (a) the lower alkyl esters of acrylic acid, methyl-substituted acrylic acid, and fumaric acid, and the nitriles corresponding to said acids, (b) N-phenylamides, N-lower-alkylamides, and N-lower-hydroxyalkyl amides of acrylic acid and methyl-substituted acrylic acid, (c) N-vinylsuccinimide and N-vinyl-phthalimide, (d) styrene and phenylacetylene and (e) 3-sulfolene, whereby upon exposure to actinic radiation said nitrone is converted to a product giving increased optical densities in the exposed image areas, while upon subsequent heat-fixing said nitrone in unexposed image areas is converted to a permanent radiation-stable product of low optical density including a reaction product of the unexposed nitrone and said unsaturated compound.

17. The light-sensitive medium of claim 16, in which said unsaturated compound is selected from the group consisting of acrylonitrile, fumaronitrile, dimethyl fumarate, acrylamide, N-phenylacrylamide, N,N′-methylenebisacrylamide, N-methylolacrylamide, N-methylolmethacrylamide, N-vinylsuccinimide, N-vinylphthalimide, styrene, phenylacetylene, and 3-sulfolene.

18. The light-sensitive medium of claim 17, in which each of the R and R′ groups of the nitrone is selected from the group consisting of phenyl, naphthyl, and substituted phenyl, said substituted phenyl having one or two substituents selected from the group consisting of dimethylamino, hydroxy, methoxy, methyl, and nitro.

19. The light-sensitive medium of claim 17, in which each of the R and R′ groups of the nitrone is selected from the group consisting of phenyl and 1-naphthyl.

20. The light-sensitive medium of claim 17, in which said photosensitive nitrone is alpha,N-diphenylnitrone.

21. The light-sensitive medium of claim 17, in which said support carries additionally a salt for increasing the reactivity of said unsaturated compound with unexposed nitrone during heat-fixing, said salt being selected from the group consisting of lithium bromide, lithium p-toluenesulfonate, and piperidinium p-toluenesulfonate.

22. The light-sensitive medium of claim 16, in which each of the R and R′ groups of the nitrone carried by said support is selected from the group consisting of phenyl and 1-naphthyl, and in which the unsaturated compound also carried by said support is N-methylolmethacrylamide.

23. The light-sensitive medium of claim 22, in which said support carries additionally piperidinium p-toluenesulfonate for increasing the reactivity of the N-methylolmethacrylamide with unexposed nitrone during heat-fixing.

24. A light-sensitive medium for forming visible heat-fixed images consisting essentially of: a support carrying a composition consisting essentially of a photosensitive nitrone having the formula RCH=N( → O)R′, wherein R and R′ are each selected from the group consisting of phenyl and 1-naphthyl; an unsaturated compound selected from the group consisting of acrylonitrile, fumaronitrile, dimethyl fumarate, acrylamide, N-phenylacrylamide, N, N′-methylene-bisacrylamide, N-methylolacrylamide, N-methylolmethacrylamide, N-vinylsuccinimide, N-vinylphthalimide, styrene, phenylacetylene and 3-sulfolene and image-intensifier means in the form of a compound selected from the group consisting of diphenylamine, p-phenylenediamine, N,N′-diphenyl-p-phenylenediamine, indole, 3-indolylacetic acid, carbazole, benzimidazole, rhodanine, and p-methoxyphenol;

whereby upon exposure to actinic radiation said nitrone is converted to a product giving increased optical densities in the exposed image areas, said intensifier means further increasing optical density responsive to said nitrone conversion upon exposure while upon subsequent heat-fixing said nitrone in unexposed image areas is converted to a radiation-stable product of low optical density including a reaction product of the unexposed nitrone and said unsaturated compound.

25. The light-sensitive medium of claim 24 in which said unsaturated compound is N-methylolmethacrylamide and said intensifier is N,N′-diphenyl-p-phenylenediamine. of 26. The light-sensitive medium of claim 24 wherein said unsaturated compound is N-methylolmethacrylamide and said intensifier is diphenylamine.

27. A light-sensitive medium for forming visible heat-fixed images consisting essentially of: a support carrying a composition consisting essentially of (1) a photosensitive nitrone having the formula RCH=N( → O) R′ wherein R and R′ are each selected from the group consisting of phenyl and 1-naphthyl; (2) N-methylolmethacrylamide, (3) piperidinium p-toluenesulfonate and (4) image intensifier means in the form of a compound selected from the group consisting od diphenylamine, p-phenylenediamine, indole, 3-indolylacetic acid, carbazole, benzimidazole, rhodanine and p-methoxyphenol;

whereby upon exposure to actinic radiation said nitrone is converted to a product giving increased optical densities in the exposed image areas, said intensifier means further increasing optical density responsive to said nitrone conversion upon exposure while upon subsequent heat-fixing said nitrone in unexposed image areas is converted to a radiation-stable product of low optical density including a reaction product of the unexposed nitrone and said N-methylolmethacrylamide, said piperidinium p-toluenesulfonate increasing the reactivity of the N-methylolmethacrylamide with said nitrone during heat fixing.

28. The light-sensitive medium of claim 27 in which said image intensifier means is diphenylamine.

29. A light-sensitive medium for forming visible heat-fixed images, consisting essentially of: a support carrying a composition consisting essentially of a photosensitive nitrone having the formula RCH=N( → 0)R′, where R is selected from the group consisting of aryl, aroyl, arylvinylene, and furyl groups and R′ is an aryl group, and at least one auxiliary compound for increasing the permanent contrast between exposed and unexposed image areas, said nitrone being adapted to be converted upon exposure to actinic radiation to a product of increased optical density and being adapted in unexposed image areas to be converted by subsequent heat-fixing to a permanent radiation-stable product of low optical density, said auxiliary compound being selected from the group consisting of an image-intensifier in the form of diphenylamine, p-phenylenediamine, N,N′-diphenyl-p-phenylenediamine, indole, 3-indolylacetic acid, carbazole, benzimidazole, rhodanine, and p-methoxyphenol, a heat-fixing catalyst in the form of tricresyl phosphate, phosphorus trichloride, phosphorus pentachloride, sulfur dioxide, thionyl chloride, acetic anhydride, and maleic anhydride, and an unsaturated heat-fixing reagent in the form of acrylonitrile, fumaronitrile, dimethyl fumarate, acrylamide, N-phenylacrylamide, N,N′-methylenebisacrylamide, N-methylolacrylamide, N-methylolmethacrylamide, N-vinylsuccinimide, N-vinylphthalimide, styrene, phenylacetylene, and 3-sulfolene.

* * * * *